US007852989B2

(12) United States Patent
Albanetti et al.

(10) Patent No.: US 7,852,989 B2
(45) Date of Patent: Dec. 14, 2010

(54) BALL BEARING DESIGN TEMPERATURE COMPENSATING X-RAY TUBE BEARING

(75) Inventors: Edward Albanetti, Danbury, CT (US); Robert O'Donnell, New Fairfield, CT (US)

(73) Assignee: Schaeffler KG, Herzogenaurach (DE)

( * ) Notice: Subject to any disclaimer, the term of this patent is extended or adjusted under 35 U.S.C. 154(b) by 18 days.

(21) Appl. No.: 12/429,514

(22) Filed: Apr. 24, 2009

(65) Prior Publication Data

US 2009/0268874 A1 Oct. 29, 2009

Related U.S. Application Data

(60) Provisional application No. 61/047,457, filed on Apr. 24, 2008.

(51) Int. Cl.
*H01J 35/10* (2006.01)

(52) U.S. Cl. ..... 378/132; 378/144

(58) Field of Classification Search ..... 378/119, 378/144, 132, 131; 384/231, 273, 275, 276, 384/290, 569
See application file for complete search history.

(56) References Cited

U.S. PATENT DOCUMENTS

| | | | | |
|---|---|---|---|---|
| 6,480,571 | B1 * | 11/2002 | Andrews | 378/131 |
| 2005/0157846 | A1 * | 7/2005 | Neumeier et al. | 378/137 |
| 2008/0118030 | A1 * | 5/2008 | Lee et al. | 378/132 |

* cited by examiner

*Primary Examiner*—Hoon Song
(74) *Attorney, Agent, or Firm*—Klaus P. Stoffel; Lucas & Mercanti, LLP

(57) ABSTRACT

The rotating anode x-ray tube has a composite outer bearing made from two rings of a high hot-hardness material and a spacer between the two rings made of a constant coefficient of thermal expansion material. The spacer is welded to the two rings providing the composite outer bearing. One inner bearing race is formed from the shaft and the other inner bearing race is a one-piece inner race mounted on the shaft while the two rings have the corresponding outer races.

17 Claims, 4 Drawing Sheets

BALL BEARING DESIGN TEMPERATURE COMPENSATING X-RAY TUBE BEARING

CROSS REFERENCE TO RELATED APPLICATIONS

This application claims the priority of U.S. Provisional Patent Application No. 61/047,457 filed Apr. 24, 2008, the contents of which are incorporated by reference herein.

FIELD OF THE INVENTION

This invention relates to a rotating anode x-ray tube and, more particularly, to a composite bearing outer ring used in a rotating anode x-ray tube.

BACKGROUND OF THE INVENTION

Typically, a rotating anode x-ray tube is made up of an evacuated envelope in which a cathode and an anode are positioned. A heating current is provided to the cathode and a large potential is created between the anode and the cathode in order to accelerate the electrons from the cathode to the anode. The anode is a rotating disk and the target area on the anode is typically a small area of the anode which is located towards the circumference of the disk.

The anode disk is supported by a shaft which in turn is supported on a bearing. The shaft is rotated at a high speed by means of electro-magnetic induction from a series of stator windings which are located outside of the evacuated envelope. The stator windings act on a cylindrical armature or sleeve which is fixed to the shaft. The bearing is positioned in the envelope between the shaft and the armature to allow the shaft and the armature to rotate, thereby rotating the disk. Typically, the inner bearing races are part of the shaft while the outer bearing races are part of a sleeve which is fixed to the envelope. Roller bodies are positioned in the races.

One of the problems associated with rotating anode x-ray tubes is that a great deal of heat is generated inside the tube which can have a deleterious effect on the bearing elements. Typically, in order to address the temperature problem, various cooling arrangements have been devised such as the ones shown in U.S. Pat. Nos. 6,445,770 and 6,445,769.

There can be a significant temperature difference between the outer races and the inner races during the starting up process until the temperature within the tube has stabilized. This temperature difference can potentially cause the outer races to grow both radially and axially much faster than the inner races. Because of this difference in thermal expansion, a large amount of internal radial clearance must be built into the bearing, causing the bearing to be noisy and to greatly reduce the life of the bearing. Typically, high temperature hardened materials are used for the outer bearing. Those materials can be expensive and thereby increase the cost associated with the bearing.

OBJECTS OF THE INVENTION

It is an object of the invention to minimize the variations and end-play of the bearing during the start up and steady state conditions in the x-ray tube. It is also the object of the present invention to reduce the overall cost associated with the bearing used in a rotating anode x-ray tube by eliminating the need for a separate bearing cooling arrangement. These and other objects of the present invention will be more readily understood by reference of the following description of the invention.

SUMMARY OF THE INVENTION

The objects of the invention are obtained by using a composite outer bearing in the rotating anode x-ray tube. More specifically, the outer bearing is a sleeve comprising a ring at each end of the sleeve made from a high hot-hardness material. Each ring has an outer race therein. A spacer is positioned between the two rings and affixed to each ring. The spacer is made from a material having a much lower coefficient of thermal expansion than the material of the ring.

Thus, the composite outer bearing takes advantage of preferential growth rate of different materials to minimize the variation in the end-play of the bearing during the start up and steady state conditions. The high hot-hardness material used to form the outer rings provide for an extended bearing life. The lower coefficient of thermal expansion of the spacer facilitates optimization such that near equal axial growth of the outer rings and the shaft components are achieved, despite temperature differentials. Bearing end-play is effectively thermally compensated.

Broadly, the bearing of the invention for use in a rotating anode x-ray tube comprises:

- a fixed, inner shaft positioned in the housing and affixed to the housing, the shaft having an inner race at one end and a cylindrical shoulder at the other end;
- at least one inner ring, positioned on the shoulder of the shaft and retained axially by staking the shaft, the inner ring having an inner race;
- a rotatable, outer sleeve affixed to the anode and surrounding the shaft, the sleeve having one ring with one outer race, another ring with another outer race, and a spacer positioned between the one ring and the other ring, the one outer race opposing the inner race on the shaft and the other outer race opposing the inner race on the inner ring;
- the one ring and the other ring made from high hot-hardness material;
- the spacer made from a constant coefficient of thermal expansion material and affixed to the one ring and the other ring; and
- roller bodies positioned between the shaft inner race and the one outer race and between the one-piece inner race and the other outer race.

The invention can also be defined as a rotating anode x-ray tube comprising:

- a vacuum housing;
- a cathode positioned in the housing;
- a rotatable anode positioned in the housing opposite the cathode;
- a fixed, inner shaft positioned in the housing and affixed to the housing, the shaft having an inner race at one end and a cylindrical shoulder at the other end;
- at least one inner ring, positioned on the shoulder of the shaft and retained axially by staking the shaft, the inner ring having an inner race;
- a rotatable, outer sleeve affixed to the anode and surrounding the shaft, the sleeve having one ring with one outer race, another ring with another outer race, and a spacer positioned between the one ring and the other ring, the one outer race opposing the inner race on the shaft and the other outer race opposing the inner race on the inner ring;
- the one ring and the other ring made from high hot-hardness material;
- the spacer made from a constant coefficient of thermal expansion material and affixed to the one ring and the other ring; and roller bodies positioned between the shaft inner race and the one outer race and between the one-piece inner race and the other outer race.

Preferably, the outer sleeve rings are made of material such as M-62 or T-5 or T-15. Suitably, the spacer is made of Incoloy 909 or a similar constant coefficient of thermal expansion material. Preferably, the spacer is affixed to the two rings by means of electron beam welding or friction welding.

Although the invention encompasses the conventional embodiment in which the inner shaft rotates inside a fixed outer sleeve, in the preferred embodiment, the outer sleeve rotates about a fixed inner shaft. This configuration allows the outer sleeve to grow mechanically away from the shaft due to its rotational speed and takes advantage of its preferential growth rate to minimize the variation in the end-play of the bearing during the start up and steady state conditions. Hence, in the present invention, the bearing end-play is effectively compensated both mechanically and thermally.

The method of sizing the spacer of the outer sleeve in the invention comprises the steps of:

specifying an initial spacer size;

calculating an initial bearing internal radial clearance;

calculating the bearing thermal growth based on a temperature profile;

calculating the bearing mechanical growth based on a rotational speed;

calculating the resultant bearing internal radial clearance;

comparing the resultant bearing internal radial clearance to a known value; and iterating the spacer size to achieve the resultant bearing internal radial clearance equal to the known value.

The known value of internal radial clearance used for comparison purposes is an empirically determined value based on the specific application that results in improvement in fatigue life due to lower vibration levels and potentially increases the life of the bearing. A simple computational routine can be employed to perform these iterative calculations and determine the optimum space size for a specific application.

The invention encompasses both a cantilevered mounted anode configuration as well as a straddle mounted anode configuration. In the cantilevered configuration, the anode is position forward of the roller bodies of the bearing. In the straddle mounted configuration, the anode is position in between at least one row of roller bodies at each end of the bearing.

While the invention is intended to encompass the conventional embodiment in which the bearing inner races are formed as part of the shaft, the preferred embodiment comprises the shaft having an inner race at one end and a cylindrical shoulder at the other end. An inner ring is positioned on the shoulder of the shaft and retained axially by staking the shaft. The inner ring has an inner race opposing one of the outer races of the sleeve. In the preferred embodiment, the inner ring is a one-piece construction and is made of material such as M-62 or T-5 or T-15.

The forward end of the shaft is preferably made of REX 20 and the rearward end of the shaft is made of 410 stainless steel or a similar stainless steel, such as 17-4PH. Preferably, the forward end is affixed to the rearward end by means of electron beam welding or friction welding. After the forward and rearward ends are affixed to each other by welding, the forward end is induction hardened to provide a suitable raceway surface for the roller bodies.

BRIEF DESCRIPTION OF THE DRAWINGS

These and other aspects of the present invention may be more readily apparent by reference to one or more of the following drawings which are presented for purposes of illustration, only.

Figure 1:
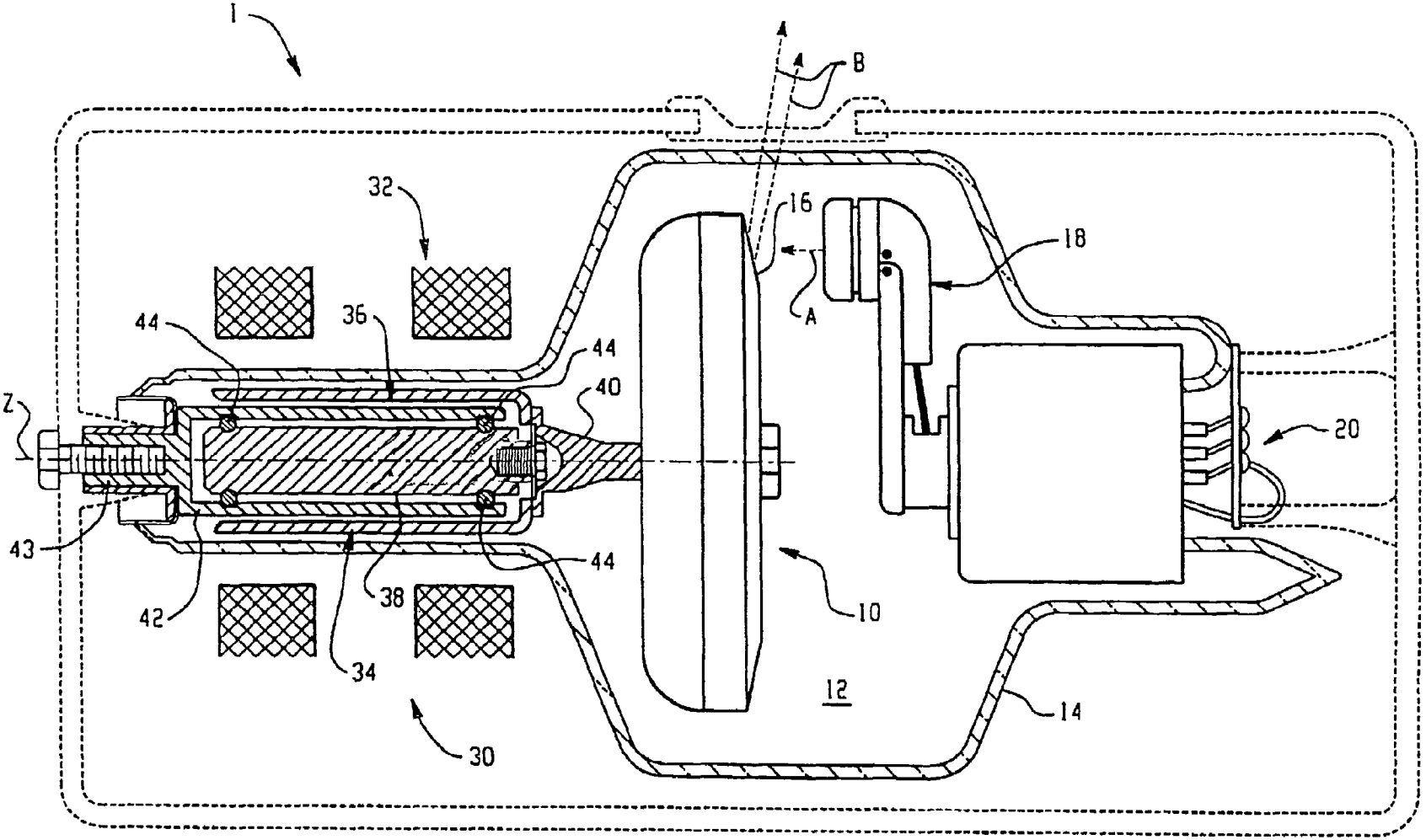
Figure 2:
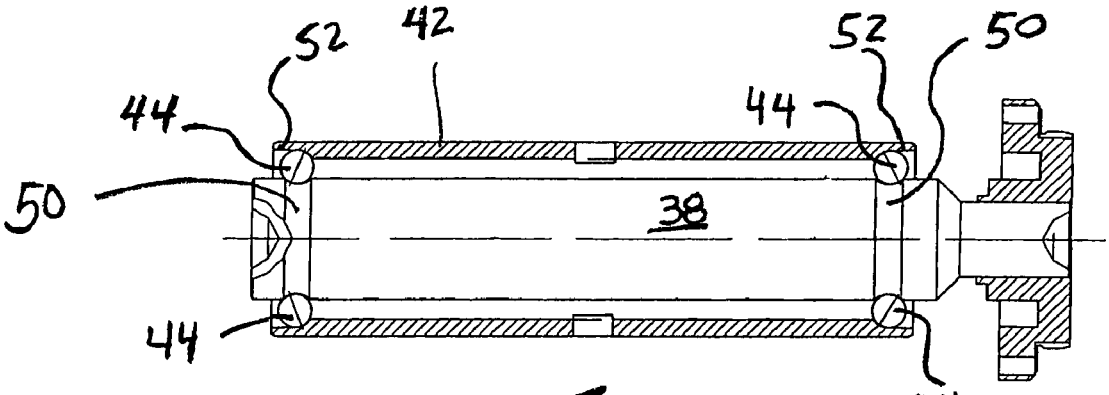
Figure 3:
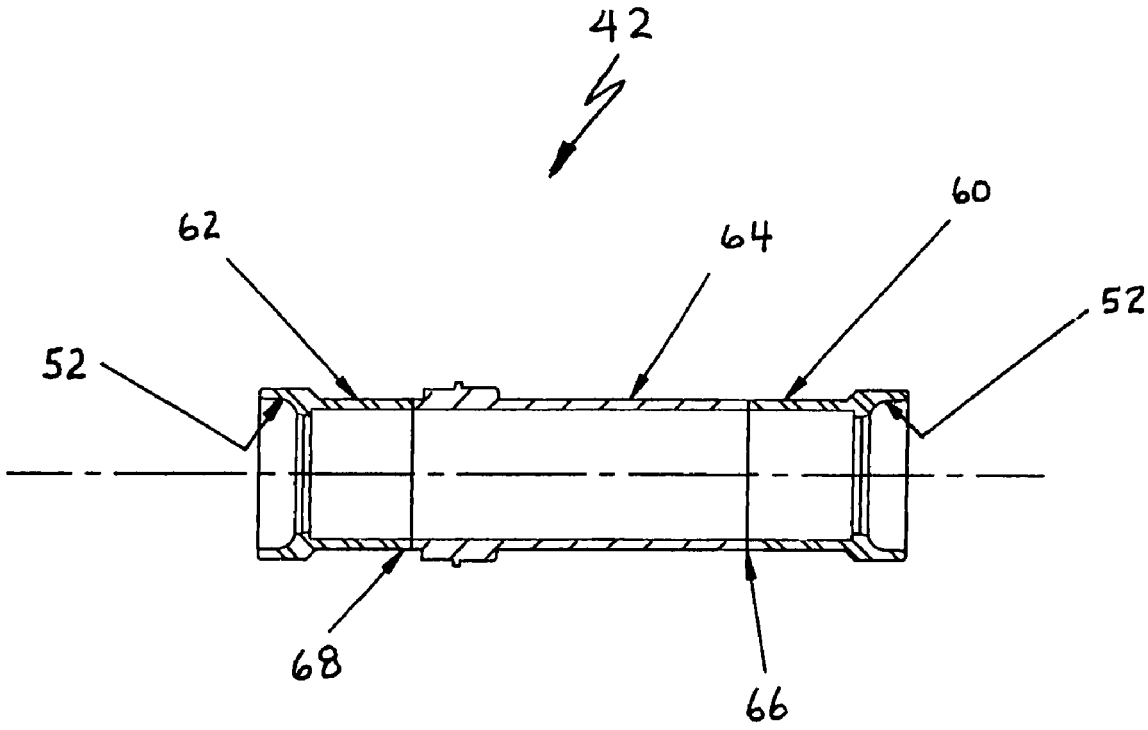
Figure 4:
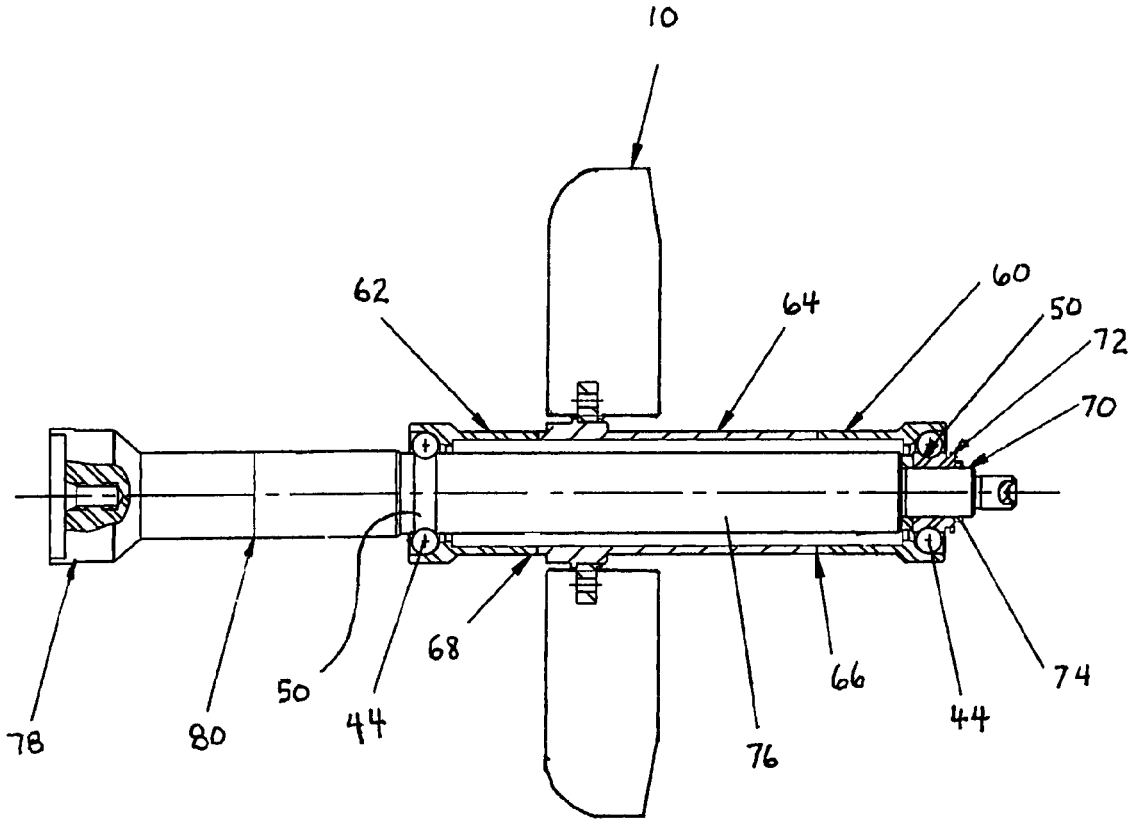

| | |
|---|---|
| FIG. 1 | illustrates a rotating anode x-ray tube of the invention; |
| FIG. 2 | illustrates the bearing of the present invention; |
| FIG. 3 | illustrates the outer sleeve of the present invention; and |
| FIG. 4 | illustrates an alternate embodiment of the bearing of the present invention. |

DETAILED DESCRIPTION OF THE DRAWINGS

FIG. 1 illustrates a rotating anode x-ray tube 1 of the type used in medical diagnostic systems includes rotating anode 10 which is operated in evacuated chamber 12 defined by vacuum envelope 14 which is formed from glass or other suitable material. The anode is disc-shaped and beveled adjacent its annular peripheral edge to define an anode surface or target area 16. Cathode assembly 18 supplies and focuses an electron beam A which strikes anode surface 16. Filament leads 20 lead in through the glass envelope to the cathode assembly to supply an electrical current to the assembly. When the electron beam strikes the rotating anode, a portion of the beam is converted to x-rays B, which are emitted from the anode surface, and a beam of the x-rays passes out of the tube through vacuum envelope 14.

Induction motor 30 rotates the anode 10. The induction motor includes a stator having driving coils 32, which are positioned outside the vacuum envelope, and a rotor 34, within the envelope, which is connected to the anode 10. The rotor includes an outer, cylindrical armature or sleeve portion 36 and is connected to shaft 38, which is axially aligned within the armature. Armature 36 and shaft 38 are connected to the anode 10 by neck 40 of molybdenum or other suitable material. Armature 36 is formed from a thermally and electrically conductive material, such as copper. When the motor is energized, the driving coils 32 induce magnetic fields in the armature which cause the armature and shaft to rotate relative to a stationary, sleeve 42, which is axially aligned with the armature and shaft and is positioned there between. The sleeve is connected at a rearward end with a mounting stub 43, which extends through the envelope 14 for rigidly supporting the sleeve.

Roller bodies 44, such as ball bearings, are positioned between the shaft 38 and the sleeve 42, allow the armature 36, and anode 10 to rotate smoothly. The bearing balls are coated with a lubricant, such as lead or silver at a thickness of about 1000-3000 Å. The x-ray tube includes both forward and rear bearing balls, respectively.

As used herein, the terms "forward," "rear," and the like, are used to define relative positions of components along an axis Z passing through the shaft 38 and anode 10. Components which are described as forward are closer to the anode, while components described as rearward are further from the anode.

The bearing of the present invention is made up of shaft 38, sleeve 42, and roller bodies 44. FIGS. 1 and 2 show a conventional x-ray tube bearing arrangement wherein shaft 38 rotates inside fixed sleeve 42 and anode 10 is cantilever mounted with at least two rows of roller bodies 44 positioned rearward of anode 10.

Turning to FIG. 2, shaft 38 has forward and rear race 50. Race 50 is an inner race. Sleeve 42 has forward and rearward outer race 52. Roller bodies 44 are positioned between inner race 50 and outer race 52, as illustrated.

Composite outer bearing sleeve 42 is illustrated in FIG. 3 having a forward ring 60, a rearward ring 62, and a spacer 64. Spacer 64 is welded by electron beam welding to outer rings 60 and 62 at weld spot 66 and 68, respectively.

FIG. 4 shows an alternate x-ray tube bearing arrangement wherein sleeve 42 rotates about shaft 38 and anode 10 is straddle mounted with at least one row of roller bodies 44 positioned at each end of the bearing. In FIG. 4, shaft 38 has inner race 50 at one end and cylindrical shoulder 70 at the other end. Inner ring 72 is positioned on shoulder 70 and retained axially by stake 74. Inner ring 72 has inner race 50 opposing outer race 52 of sleeve 42. FIG. 4 shows inner ring 72 as a one-piece construction.

In FIG. 4, shaft 38 has forward end 76 affixed to rearward end 78 at weld spot 80.

It is believed that by reducing the amount of high hot-hardness material such as M-62 used in the present invention will offset any welding cost. Furthermore it is believed that improvement in fatigue life due to lower vibration levels will potentially increase the life of the bearing.

REFERENCE CHARACTERS

| | |
|---|---|
| 1 | X-ray tube |
| 10 | Anode |
| 12 | Evacuated chamber |
| 14 | Vacuum envelope |
| 16 | Anode surface |
| 18 | Cathode assembly |
| 20 | Filament leads |
| 30 | Induction motor |
| 32 | Driving coils |
| 34 | Rotor |
| 36 | Cylindrical armature |
| 38 | Shaft |
| 40 | Neck |
| 42 | Sleeve |
| 43 | Mounting stub |
| 44 | Roller bodies |
| 50 | Inner race |
| 52 | Outer race |
| 60 | Forward ring |
| 62 | Rearward ring |
| 64 | Spacer |
| 66 | Weld spot |
| 68 | Weld spot |
| 70 | Cylindrical Shoulder |
| 72 | Inner Ring |
| 74 | Stake |
| 76 | Forward End of Shaft |
| 78 | Rearward end of Shaft |
| 80 | Weld Spot |
| A | Electron beam |
| B | x-rays |

The invention claimed is:

1. A rotating anode x-ray tube comprising:

a vacuum housing;

a cathode positioned in the housing;

a rotatable anode positioned in the housing opposite the cathode;

a fixed, inner shaft positioned in the housing and affixed to the housing, the shaft having an inner race at one end and a cylindrical shoulder at the other end;

at least one inner ring, positioned on the shoulder of the shaft and retained axially by staking the shaft, the inner ring having an inner race;

a rotatable, outer sleeve affixed to the anode and surrounding the shaft, the sleeve having one ring with one outer race, another ring with another outer race, and a spacer positioned between the one ring and the other ring, the one outer race opposing the inner race on the shaft and the other outer race opposing the inner race on the inner ring;

the one ring and the other ring made from high hot-hardness material;

the spacer made from a constant coefficient of thermal expansion material and affixed to the one ring and the other ring; and roller bodies positioned between the shaft inner race and the one outer race and between the one-piece inner race and the other outer race.

2. The tube of claim 1, wherein the one ring and the other ring are made of M-62, T-5 or T-15.

3. The tube of claim 1, wherein the spacer is made of Incoloy 909.

4. The tube of claim 1, wherein the spacer is affixed to the one ring and the other ring by electron beam welding or friction welding.

5. The tube of claim 1, wherein the anode is cantilever mounted to the sleeve.

6. The tube of claim 1, wherein the anode is straddle mounted to the sleeve.

7. The tube of claim 1, wherein the shaft has a forward end made of REX 20 affixed to a rearward end made of 410 stainless steel by friction welding or electron beam welding.

8. The tube of claim 7, wherein the shaft comprises a means for induction hardening the forward end after the forward end and the rearward end are affixed to each other by welding.

9. The tube of claim 1, wherein the inner ring is a one-piece construction.

10. A bearing for a rotating anode x-ray tube, comprising:

a fixed, inner shaft positioned in the housing and affixed to the housing, the shaft having an inner race at one end and a cylindrical shoulder at the other end;

at least one inner ring, positioned on the shoulder of the shaft and retained axially by staking the shaft, the inner ring having an inner race;

a rotatable, outer sleeve affixed to the anode and surrounding the shaft, the sleeve having one ring with one outer race, another ring with another outer race, and a spacer positioned between the one ring and the other ring, the one outer race opposing the inner race on the shaft and the other outer race opposing the inner race on the inner ring;

the one ring and the other ring made from high hot-hardness material;

the spacer made from a constant coefficient of thermal expansion material and affixed to the one ring and the other ring; and roller bodies positioned between the shaft inner race and the one outer race and between the one-piece inner race and the other outer race.

11. The bearing of claim 10, wherein
the one ring and the other ring are made of M-62, T-5 or T-15.

12. The bearing of claim 10, wherein
the spacer is made of Incoloy 909.

13. The bearing of claim 10, wherein
the spacer is affixed to the one ring and the other ring by electron beam welding.

14. The bearing of claim 10, wherein
the spacer is affixed to the one ring and the other ring by friction welding.

15. The bearing of claim 10, wherein
the shaft has a forward end made of REX 20 affixed to a rearward end made of 410 stainless steel by friction welding or electron beam welding.

16. The bearing of claim 15, wherein
the shaft comprises a means for induction hardening the forward end after the forward end and the rearward end are affixed to each other by welding.

17. The bearing of claim 10, wherein
the inner ring is a one-piece construction.

* * * * *